US009827152B1

(12) United States Patent
Calkin

(10) Patent No.: US 9,827,152 B1
(45) Date of Patent: Nov. 28, 2017

(54) RESCUE HARNESS WITH PROTECTIVE DRAG SHEET

(71) Applicant: Skedco, Inc., Tualatin, OR (US)

(72) Inventor: Carston R. Calkin, Tualatin, OR (US)

(73) Assignee: Skedco, Inc., Tualatin, OR (US)

( * ) Notice: Subject to any disclaimer, the term of this patent is extended or adjusted under 35 U.S.C. 154(b) by 0 days.

(21) Appl. No.: 15/338,113

(22) Filed: Oct. 28, 2016

(51) Int. Cl.
*A61G 1/044* (2006.01)
*A61G 1/048* (2006.01)
*A61G 1/01* (2006.01)

(52) U.S. Cl.
CPC ..... *A61G 1/044* (2013.01); *A61G 1/048* (2013.01); *A61G 1/01* (2013.01)

(58) Field of Classification Search
CPC . A61G 1/00; A61G 1/01; A61G 1/013; A61G 1/04; A61G 1/044; A61G 1/048; A61F 5/37; A61F 5/3707; A61F 5/3769; A61F 5/3776; A61F 5/3784
USPC ..... 5/628, 625, 627; 128/869, 870, 875, 876
See application file for complete search history.

(56) References Cited

U.S. PATENT DOCUMENTS 1,270,107 A 6/1918 Boardman
2,361,789 A 10/1944 Nicholas
2,366,082 A 12/1944 Baker
2,899,692 A 7/1955 Finken
2,788,530 A 4/1957 Ferguson
2,940,443 A * 6/1960 Baker ..... A61F 5/3784 128/874
3,046,982 A 7/1962 Davis
3,158,875 A 12/1964 Fletcher
3,287,895 A 11/1966 Hire
3,707,734 A 1/1973 Matthews
4,127,120 A 11/1978 Applegate
4,151,842 A 5/1979 Miller
4,283,068 A 8/1981 Keyser
4,347,635 A 9/1982 Eisenhauer
4,601,075 A 7/1986 Smith
4,858,625 A * 8/1989 Cramer ..... A61F 5/3784 128/872
5,014,374 A 5/1991 Williams
5,027,833 A 7/1991 Calkin
5,048,134 A 9/1991 Dennill et al.
(Continued)

OTHER PUBLICATIONS

Veasey et al., Confined Space Entry and Emergency Response, 2002, pp. 429-433, The McGraw-Hill Companies, Inc., U.S.
ARC Products, Med-Sled Vertical Lift Rescue, 2009, 2 pgs.

*Primary Examiner* — Robert G Santos
(74) *Attorney, Agent, or Firm* — Stoel Rives LLP

(57) ABSTRACT

A stretcher including a flexible base panel sized to support a person lying thereon during a rescue or extrication operation. The base panel includes a header end and an opposite footer end, and further includes a support mat resting on the base panel between the header and footer ends. The stretcher further includes a stability strap coupled to the base panel and fixedly attached to the rear surface of the support mat, the stability strap operable to retain the support mat in position against the flexible panel during use. The rescue stretcher may further include a pair of shoulder straps and leg straps fixedly coupled to the support mat for securing the person to the base panel. A securement strap may be coupled to the base panel and extend across the flexible base panel to help prevent the injured person from rolling off the sides of the stretcher.

16 Claims, 4 Drawing Sheets

(56) References Cited

U.S. PATENT DOCUMENTS

| | | | | |
|---|---|---|---|---|
| 5,148,815 | A * | 9/1992 | Britton | A61F 5/3776 128/870 |
| 5,211,186 | A | 5/1993 | Shoemaker et al. | |
| 5,285,797 | A | 2/1994 | Zeller | |
| 5,729,850 | A | 3/1998 | Eskeli | |
| D421,413 | S | 3/2000 | Calkin | |
| 6,065,165 | A * | 5/2000 | Delk | A61G 1/01 5/625 |
| 6,871,368 | B2 | 3/2005 | Calkin | |
| 6,966,087 | B2 | 11/2005 | Robinette | |
| 7,422,220 | B2 | 9/2008 | Walkingshaw et al. | |
| 7,810,820 | B2 | 10/2010 | Wolf et al. | |
| 8,286,284 | B2 * | 10/2012 | Fee | A61G 1/01 5/628 |
| 8,677,530 | B2 | 3/2014 | Calkin | |
| D712,796 | S | 9/2014 | Calkin | |
| 9,173,789 | B2 * | 11/2015 | Haskell | A61G 1/01 |
| 2004/0088794 | A1 | 5/2004 | Calkin | |
| 2007/0136950 | A1 | 6/2007 | Zuercher | |
| 2008/0184488 | A1 * | 8/2008 | Fee | A61G 1/01 5/628 |
| 2010/0005593 | A1 | 1/2010 | Bowling et al. | |
| 2010/0233922 | A1 | 9/2010 | Cynamon | |
| 2012/0102650 | A1 | 5/2012 | McGlynn | |
| 2012/0272451 | A1 * | 11/2012 | Haskell | A61G 1/01 5/628 |

* cited by examiner

RESCUE HARNESS WITH PROTECTIVE DRAG SHEET

TECHNICAL FIELD

The field of the disclosure relates generally to rescue stretchers with straps for securing and transporting an injured person to the rescue stretcher during emergency extrication.

BACKGROUND

Transporting an incapacitated or injured person to a hospital or other treatment facility is often an essential part of providing proper medical care. An ambulance, helicopter, or other similar vehicle is well-known for such transport. However, in some instances, such as when the injured person is in a forested area, on an embankment, or on a battlefield, transport vehicles may have difficulty accessing the location of the injured person. In such cases, the injured person is typically first transported from the injury site to the ambulance (or other rescue vehicle) and thereafter taken to the hospital or other treatment facility. Lightweight and easily deployable stretchers, litters, and other similar devices are generally known for facilitating such casualty movement. To help prevent further injury, these devices generally include restraints or straps to immobilize the injured person during transport.

The present inventor has recognized some disadvantages with such lightweight stretchers. For instance, during use of the stretcher, the straps typically extend transversely across the stretcher and are tightly cinched to restrain the person on the stretcher. One disadvantage of this configuration is that the injured person is primarily restrained via the compressive force of the tightened straps, which may complicate or exacerbate existing injuries. In addition, while transverse straps may help prevent the injured person from rolling off the sides of the rescue stretcher, such straps are not particularly well-suited for preventing the person from sliding toward the top or bottom ends of the stretcher. Preventing this movement is a great concern during certain evacuation scenarios, such as air-lift rescue operations or transport on sloped terrains, where gravitational forces pull the injured person and may cause sliding off the top or bottom ends of the stretcher.

In addition, many lightweight stretchers lack sufficient support or padding for the injured person to minimize the potential of causing further injury during transport. For example, during some rescue operations, the injured person may be dragged across rough terrain (e.g., rocks, rubble, or other debris) on the lightweight stretcher. Without padding, the debris may cause discomfort and possibly further injury as the injured person is dragged through the debris. Moreover, many lightweight stretchers are not sufficiently sturdy or otherwise equipped to support air lift evacuations while firmly restraining the victim in the rescue stretcher to avoid causing further injury.

Accordingly, the present inventor has recognized a need for an improved rescue stretcher that offers adequate securement straps to arrest movement along the top, bottom, and sides of stretcher, offers attachment points to facilitate air lift evacuations, and provides protective support for the injured person during. In addition, the present inventor has recognized a need for an improved rescue stretcher specifically adapted for rescue in confined spaces. Additional aspects and advantages will be apparent from the following detailed description of preferred embodiments, which proceeds with reference to the accompanying drawings.

DETAILED DESCRIPTION OF PREFERRED EMBODIMENTS

Figure 1:
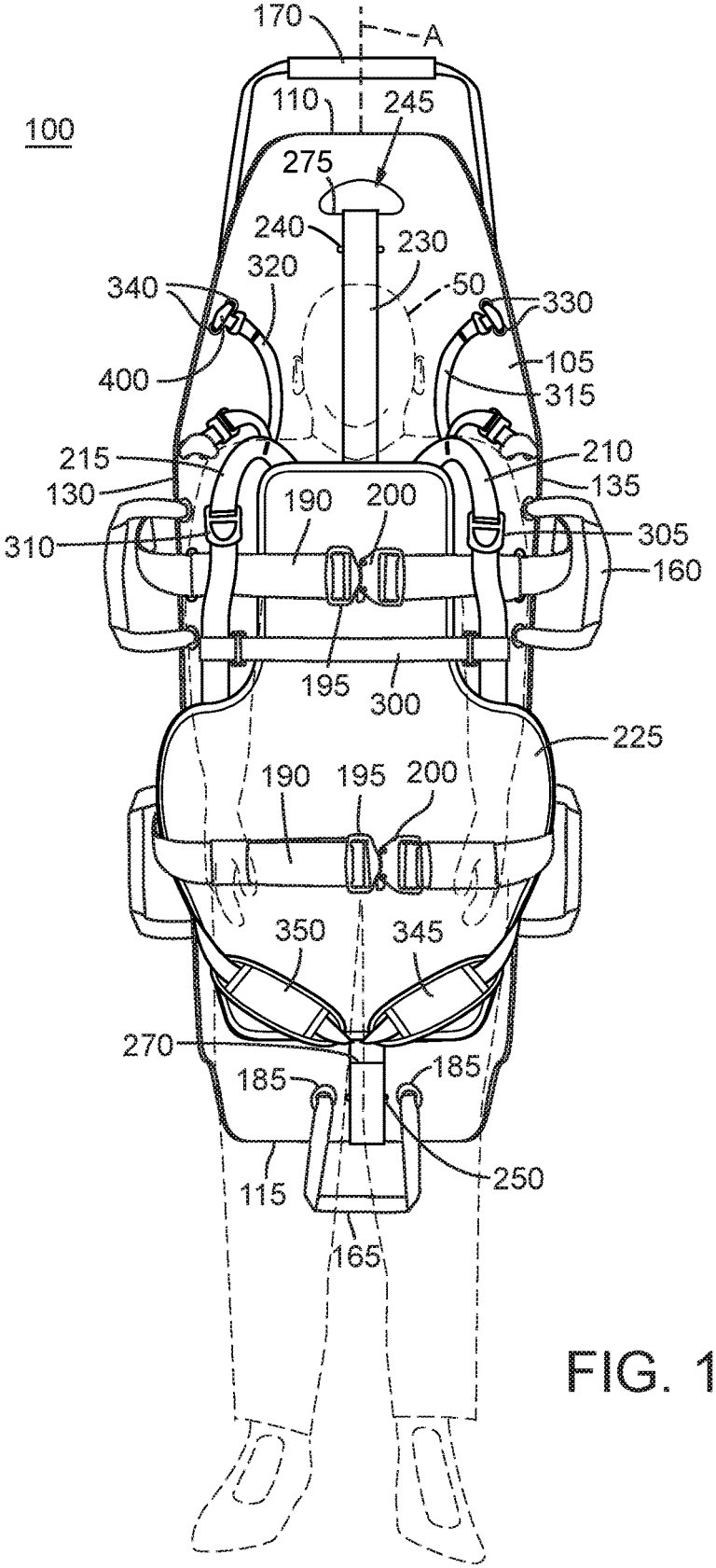
FIG. 1 is a top view of a rescue stretcher in an operative configuration in accordance with one embodiment.

With reference to the drawings, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

FIGS. 1-4 illustrate various details of a rescue stretcher 100 that may be used to support and safely extract an injured person 50 from a hazardous environment. Rescue stretcher 100 includes an elongated, flexible base panel 105 panel having a plurality of eyelets 140, 145, 150, 155 spaced along left and right peripheral edges 130, 135, respectively (see FIG. 3) of the base panel 105. A plurality of loop handles 160 are weaved through the eyelets 140, 145, 150, 155 to couple the loop handles 160 to the base panel 105. Base panel 105 further includes a plurality of eyelets 330, 340 spaced along the header end 110 to receive a drag strap 170, and eyelets 185 spaced along footer end 115 of the base panel 105 through which is weaved a loop handle 165. As further described in detail below, the loop handles 160, 165 may be used to aid evacuation personnel in carrying the injured person 50 from the hazardous environment to another location for treatment. The rescue stretcher 100 further includes a plurality of securement straps 190, 195 shoulder straps 210, 215, and leg straps 345, 350, each of which is coupled to the base panel 105 and operable to secure the injured person 50 to the base panel 105 for transport. The shoulder straps 210, 215 each include lift buckles 305, 310 that can be used for air-lift rescues as further described in detail below. In some embodiments, the base panel 105 further includes a support mat 225 having a sufficient thickness to support the person 50 and to help protect against debris or other hazards that may cause further injury or discomfort to the person 50, such as during a dragging extraction.

In one example configuration, the securement straps 190, 195 extend transversely across the base panel 105. When securement straps 190, 195 are tightened, base panel 105 rolls inwardly to at least partially cradle person 50 and help prevent person 50 from rolling off the base panel 105 (e.g., such as via left and right edges 130, 135). The shoulder straps 210, 215 and leg straps 345, 350, when secured and tightened, support the person 50 and collectively limit movement of the person 50 toward the header end 110 and the footer end 115 of rescue stretcher 100. As illustrated, the shoulder straps 210, 215 each extend across over a corresponding shoulder of the injured person 50 and couple to an underside of the support mat 225 to arrest the shoulder and help prevent the injured person 50 from slipping or moving toward header end 110 of base panel 105. Similarly, the leg straps 345, 350 extend inwardly from the edges 130, 135, respectively, toward the center of the support mat 225 and couple to an underside of the support mat 225 to arrest movement of the person downwardly toward the footer end 115.

The following describes further detailed aspects of this and other embodiments of rescue stretcher 100. In the following description of the figures and any example embodiments, reference may be made to using the rescue stretcher disclosed herein to support and transport injured person. It should be understood that any such references merely refer to one prospective use for such a rescue stretcher and should not be considered as limiting. Other uses for such rescue stretcher with the characteristics and features described herein are possible, including uses to transport captured animals/game, or transporting equipment, firewood, ammunition, or other heavy loads (including both military and civilian uses). Still other uses not specifically described herein may be possible.

In addition, the following disclosure may include references to an injured person's body parts and/or particular regions of the body. It should be understood that any such discussion is meant to facilitate description and establish a frame of reference relating to a typical injured person with all limbs and body parts intact. Accordingly, any such references are for convenience only and should not be considered as limiting.

With general reference to FIGS. 1-4, rescue stretcher 100 includes an elongated base panel 105 formed of a lightweight and flexible material with strength and durability characteristics suitable for supporting the weight of an injured person 50 during transport. In one embodiment, base panel 105 comprises a single sheet of lightweight plastic material, such as medium-density polyethylene or a synthetic thermoplastic resin, selected for durability, strength, flexibility and resistance to damage (such as from cutting, scarring, denting, breaking, and deforming) to provide a suitable rescue stretcher 100 for carrying injured people. Base panel 105 includes a header end 110 and a footer end 115 opposite header end 110. Base panel 105 further includes opposite front and back surfaces 120, 125 and opposite left and right peripheral edges 130, 135. To establish a frame of reference, front surface 120 refers to a surface of base panel 105 that receives injured person 50 during use of rescue stretcher 100. Back surface 125 refers to the opposite surface of the base panel 105 that may contact the ground, such as during a dragging operation.

Overall, base panel 105 may have suitable dimensions for receiving and comfortably supporting injured person 50, though in some embodiments, the base panel 105 may not extend entirely underneath the injured person 50 during deployment. Such configuration may provide the injured person 50 the freedom to bend at the hips, thereby allowing greater flexibility for the rescue stretcher 100 to operate in tight spaces and turn corners. For instance, in one example embodiment, base panel 105 may have a length (as measured from header end 110 to footer end 115) ranging from between 40 to 50 inches and a width (as measured from left edge 130 to right edge 135) ranging from between 24 to 30 inches. Base panel 105 may range in thickness from between 1/16 inches to about 1/4 inches. It should be understood that the particular dimensions described illustrate one example embodiment and that any suitable dimensions may be used. For instance, the length and width dimensions may be smaller for rescue stretchers targeted primarily for use with children, or may be wider and/or longer to accommodate various sizes for adult use.

Figure 2:
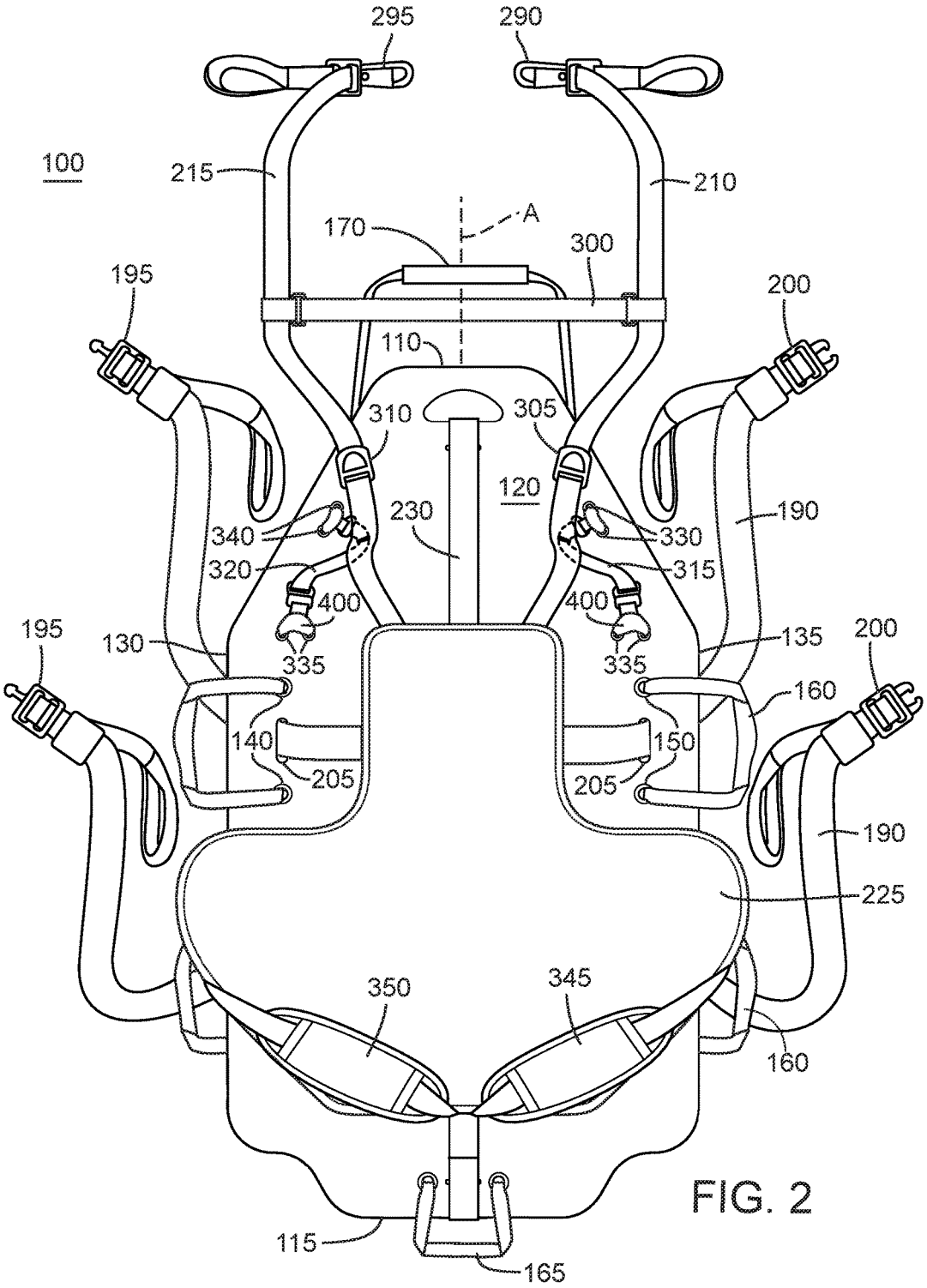
FIG. 2 is a top view of the rescue stretcher of FIG. 1 in a flat and relaxed configuration with a variety of straps of the rescue stretcher illustrated in an uncoupled configuration.
Figure 3:
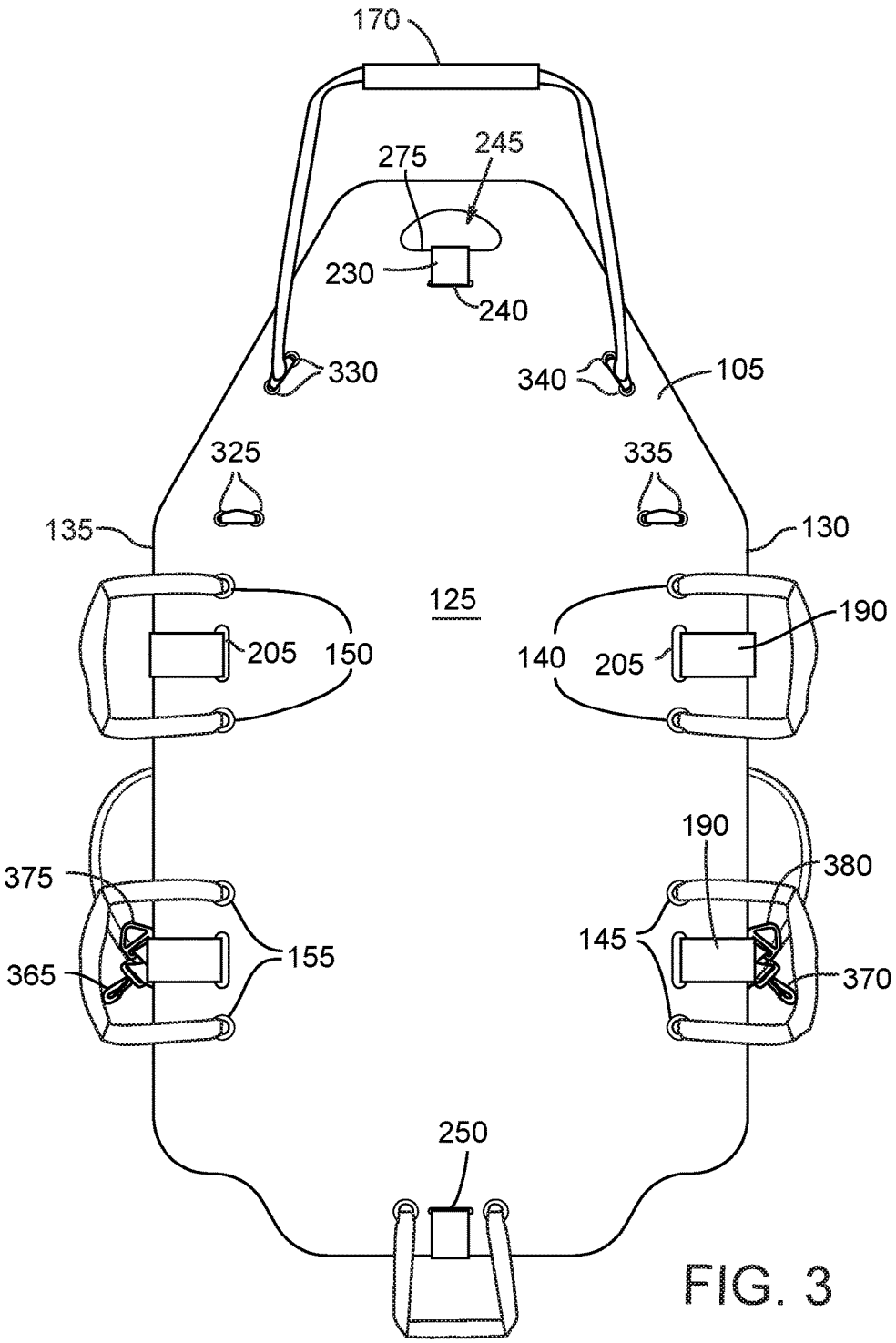
FIG. 3 is a rear view of the rescue stretcher of FIG. 1 in a flat and relaxed configuration.

As illustrated in FIGS. 1-3, in some embodiments, base panel 105 may not have a uniform width throughout, but may include one or more tapered sections. For instance, as illustrated in FIG. 2, left and right edges 130, 135 of base panel 105 may taper inwardly toward header end 110 and toward footer end 115 in some embodiments. In some embodiments, the left and right edges 130, 135 may uniformly and gradually taper toward header end 110 to define a generally trapezoidal upper region for supporting the head of the injured person 50. In such embodiments, base panel 105 is narrower at header end 110 as compared to a generally central body-supporting region of the base panel 105. In such a configuration, rescue stretcher 100 receives and supports the head of injured person 50 without obstructing the sides of the head of injured person 50 when rescue stretcher 100 is in an operative condition (for example, as illustrated in FIG. 1). Similarly, left and right edges 130, 135 may gradually taper or curve inwardly toward the footer end 115 to accommodate the lower leg region of the injured person 105.

With general reference to FIG. 3, base panel 105 includes a plurality of eyelets or apertures 140, 145, 150, 155 that may drilled, cut, punched, or otherwise formed using any suitable techniques. In some embodiments, some or all of eyelets 140, 145, 150, 155 may be reinforced using conventional metal grommets (which may also be referred to as eyelets) to reduce the risk of tearing portions of base panel 105. The eyelets 140, 145, 150, 155 may be spaced inwardly between two to four inches from edges 130, 135, respectively of the base panel 105. In one embodiment, eyelets 140, 145 on the edge 130 of the base panel 105 and eyelets 150, 155 on the edge 135 of the base panel 105 are arranged in a mirrored configuration such that eyelets 140 horizontally align with eyelets 150, and eyelets 145 horizontally align with eyelets 155.

The rescue stretcher 100 includes a plurality of loop handles 160, each loop handle 160 threaded through a corresponding one of the eyelets 140, 145, 150, 155 of base panel 105. In such configuration, the loop handles 160 form handle pairs on either side of the base panel 105, with each loop handle 160 sufficiently spaced apart from an adjacent loop handle 160, to provide adequate spacing to allow for people to carry rescue stretcher 100 during an extraction operation as illustrated in FIG. 1. Loop handles 160 are generally sized to accommodate an adult human hand and may be formed from reinforced webbing material to provide sufficient strength for carrying the load on the base panel 105. In other embodiments, loop handles 160 may be formed from other suitable materials. Some other embodiments may include more or fewer loop handles 160 arranged in a different configuration as described herein. For example, as illustrated in the figures, the rescue stretcher 100 may include an additional loop handle 165 located adjacent the footer end 115 of the base panel 105 to allow rescue personnel to position themselves at the foot of the base panel 105 to carry person 50 through narrow doors or other passages.

The rescue stretcher 100 may include a drag strap 170 threaded through a pair of apertures 330, 340 located along header end 110 of the base panel 105. The drag strap 170 may attach along the back surface 125 of the base panel 105 and extend upwardly beyond the header end 110 of rescue stretcher 100. The drag strap may have a looped handle to provide a grasping point for rescue personnel. In some embodiments, the drag strap 170 may be made of reinforced webbing or other suitable material with sufficient tensile strength for carrying out a dragging extraction operation of an adult person 50. In other embodiments, rescue stretcher 100 may include multiple drag straps for facilitating dragging by more than one rescuer or allowing a single rescuer to pull the person 50 with both hands. For example, instead of a looped drag strap 170, rescue stretcher 100 may include two individual straps without a looped handle, where one strap is laterally spaced apart from the other strap and each is threaded through an individual eyelet on header end 110. Other arrangements not specifically described herein may be possible.

Figure 4:
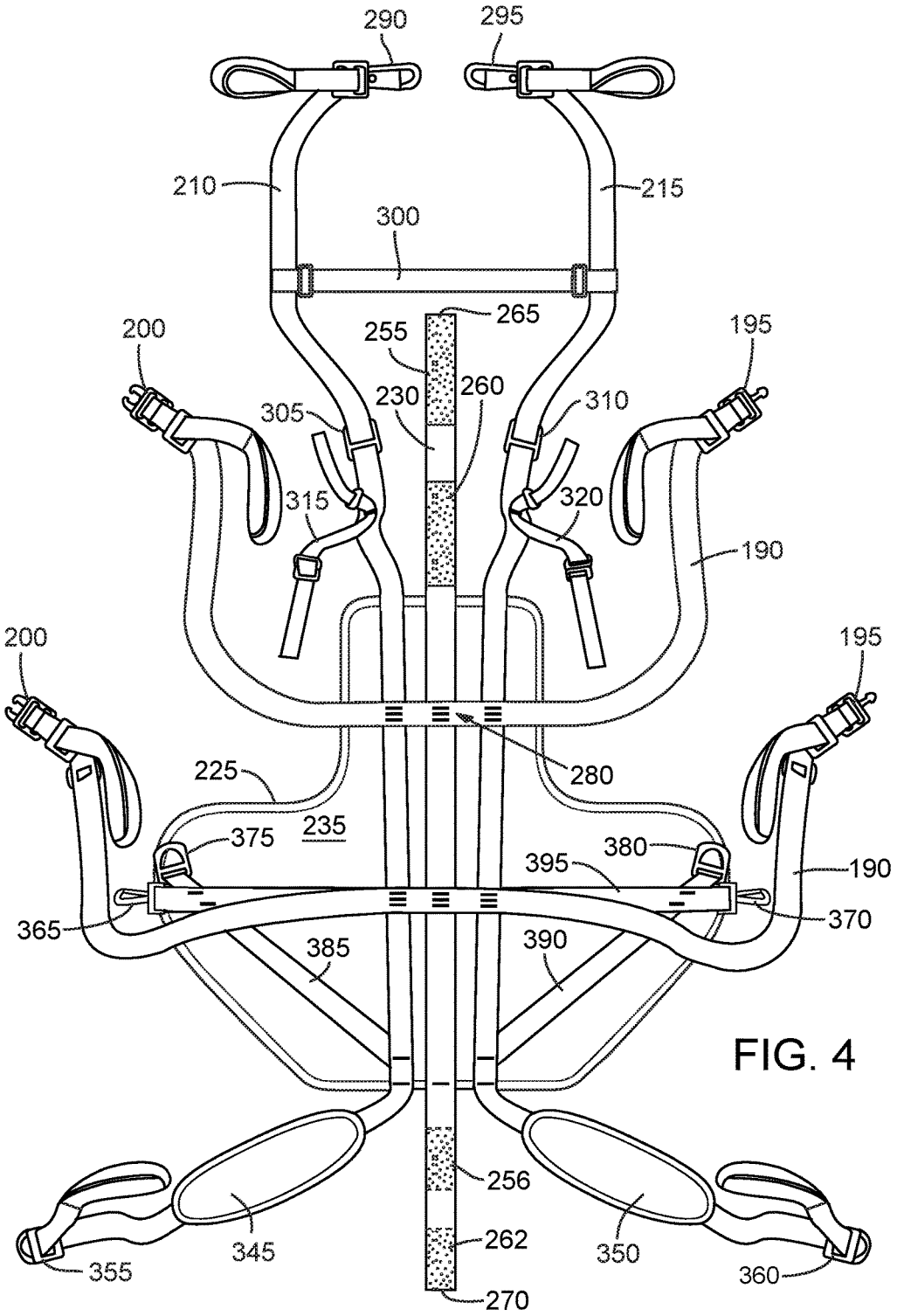
FIG. 4 is a rear view of a support mat of the rescue stretcher of FIG. 1 illustrating the variety of straps coupled to the support mat in accordance with one embodiment.

With particular reference to FIGS. 2-4, the following description provides additional details relating to an example arrangement and functionality of the plurality of straps of the rescue stretcher 100 for securing the injured person 50. As illustrated in the figures, rescue stretcher 100 includes a padded support mat 225 having a suitable thickness to help support the person 50 and to protect against debris or other hazards that may cause further injury or discomfort to the person 50, such as during a dragging extraction. In some embodiments, the padded support mat 225 may have a thickness ranging from about 0.25 inches to about 1.0 inches. In other embodiments, the support mat 225 may have different suitable thickness as desired.

The rescue stretcher 100 includes an elongate stability strap 230 stitched or otherwise fixedly coupled to a rear surface 235 the support mat 225, the stability strap 230 generally extending along a longitudinal axis A of the rescue stretcher 100. When the stability strap 230 is coupled to the base panel 105, the stability strap 230 helps stabilize the support mat 225 to help prevent the support mat 225 from slipping or otherwise sliding against the base panel 105. The stability strap 230 may be coupled to the base panel 105 along both the header and footer ends 110, 115. With general reference to FIGS. 2 and 4, the following briefly describes an example coupling arrangement of the stability strap 230 to the base panel 105.

With particular reference to FIG. 2, the header end 110 of the base panel 105 includes a first opening 240 and a second opening 245 formed thereon and offset from each other, the openings 240, 245 positioned substantially centered along the axis A of the rescue stretcher 100. The footer end 115 also includes a third opening 250 substantially centered along the axis A. In such arrangement, the openings 240, 245, 250 are generally aligned relative to each other along the axis A. In some embodiments, the width of the openings 240, 250 may be slightly larger than the width of the stability strap 230 to help minimize slippage or transverse movement of the stability strap 230, thereby retaining the support mat 230 firmly in position along a substantially central axis of the base panel 105. As illustrated in FIG. 4, the stability strap 230 may include hook-and-loop sections 255, 260 arranged adjacent an end 265 of the stability strap 230. The opposite end 270 of the stability strap 230 may also include hook-and-loop sections 256, 262 arranged on an underside (with reference to the illustrated embodiment in FIG. 4) of the stability strap 230.

Prior to coupling the stability strap 230 to the base panel 105, the support mat 225 is first laid on the base panel 105, with its rear surface 235 contacting the base panel 105 and the stability strap 230 extending beyond a top end 232 of the support mat 225 and beyond a bottom end 234 of the support mat 225. To couple the stability strap 230 to the base panel 105, the end 265 of the stability strap 230 is first stretched passed the first opening 240 on the base panel 105 and weaved through the second opening 245, thereby positioning the end 265 of the stability strap 230 along the rear of the base panel 105. Turning to FIG. 3, the end 265 of the stability strap 230 is weaved back through the first opening 240 and pulled through to tighten the strap 230 against a wall 275 of the opening 245. With the end 265 weaved through the first opening 240, the hook-and-loop sections 255, 260 are coupled to one another to hold the stability strap 230 in position. With general reference to FIG. 2, the end 265 of the stability strap 230 is positioned underneath (i.e., hidden from view in the embodiment of FIG. 2), with the end 265 resting against and contacting the base panel 105.

Along the footer end 115 of the base panel 105, the opposite end 270 of the stability strap 230 is weaved through the opening 250 and over the footer end 115 along the rear of the base panel 105 (see FIG. 3). The stability strap 230 may then be tightened against the footer end 115 and attached via the hook-and-loop sections 256, 262 on the top surface of the base panel 105.

With reference to FIGS. 1 and 2, the rescue stretcher 100 includes a plurality of securement straps 190 stretching transversely across base panel 105 and over person 50 for securing person 50 in rescue stretcher 100 when in use. Each securement strap 190 includes mating first and second buckle parts 195, 200 of a two-piece buckle system for securing person 50 on rescue stretcher 100. In an assembled configuration of the rescue stretcher 100, the securement straps 190 are threaded through slits or openings 205 formed along the peripheral edges 130, 135 of the base panel 105 to secure the securement strap 190 to the base panel 105. When threaded through the slits 205, a portion of the securement straps 190 extends underneath the base panel 105 (see FIG. 3) and beyond the peripheral edges 130, 135. When the securement straps 190 are fastened via the mating buckles 195, 200 and cinched tightly over the injured person 50, the securement straps 190 restrain the injured person 50 against the base panel 105, and also maintain the inwardly curved or rolled profile of the rescue stretcher 100 to further protect the injured person 50.

As illustrated in FIG. 4, in some embodiments, a generally central region 280 of the securement straps 190 may be stitched or otherwise fixedly attached to a rear surface 235 of the support mat 225 to keep both the support mat 225 and the securement straps 190 properly aligned and promote better securement of the person 50 in the rescue stretcher 100. Preferably, the securement straps 190 are each made of a continuous elongate strip of sturdy fabric, such as woven nylon webbing, although other materials may also be suitable. In other embodiments, straps 190 may not be continuous and may instead comprise multiple segments of material. In addition, various buckle types may be used for two-piece buckle, such as a three-way buckle, double bar buckle, swivel bar buckle, or others. Preferably, the first and second buckle parts 195, 200 are each constructed from strong materials, such as metals, but may otherwise be constructed from other suitable materials.

In addition to the securement straps 190, rescue stretcher 100 includes a pair of shoulder straps 210, 215 stitched or otherwise fixedly attached to a rear portion 235 of the support mat 225. The shoulder straps 210, 215 each extend from the top end 232 of the support mat 225, and include buckles 290, 295, respectively, attached to the ends thereof. The buckles 290, 295 are used to couple the shoulder straps 210, 215 to corresponding buckles 375, 380 attached to the rear portion 235 of the support mat 225 as further described in detail below. In some embodiments, the buckles 375, 380 may be attached to ends of a webbing strap 385, 390, respectively, that is in turn stitched or otherwise fixed attached to the rear portion 235 of the support mat 225.

In some embodiments, a connector strap 300 stretches transversely across and links the shoulder straps 210, 215 together, with the connector strap 300 helping to stabilize the shoulder straps 210, 215 when the injured person 50 is transported. The shoulder straps 210, 215 each include a lift buckle 305, 310, respectively, affixed thereto, the lift buckles 305, 310 providing vertical lift attachment points for use with a lifting bridle or spreader bar (not shown) to airlift the rescue stretcher 100 as needed. The shoulder straps 210, 215 may also include adjustment sections (not shown) for snuggly cinching shoulder strap 210, 215 over the injured person 50 to accommodate people of different size and bulk on rescue stretcher 100, and/or to permit a desired degree of adjustability for tightly securing an injured person 50 to rescue stretcher 100 as may be necessary.

In an assembled configuration of the rescue stretcher 100, the shoulder straps 210, 215 are stitched or otherwise coupled to the rear portion 235 of the support mat 225 as previously mentioned. In addition, the shoulder straps 210, 215 may also be stitched or otherwise fixedly attached to supporting straps 315, 320, respectively, which are in turn coupled to the base panel 105. In one embodiment, the supporting strap 315 may be weaved through a pair of eyelets 325, 330 formed along the right peripheral edge 135, and the supporting strap 320 may be weaved through a pair of eyelets 335, 340 formed along the left peripheral edge 130. In another embodiment, the supporting straps 315, 320 may instead be coupled to a portion 400 of the drag strap 170, with the portion 400 coupled to the base panel 105 via the 325, 330 and the eyelets 335, 340 to couple the drag strap 170 to the base panel 105. In either embodiment, the supporting straps 315, 320 help retain the shoulder straps 210, 215 in an appropriate position relative to the support mat 225 to facilitate the loading of an injured person 50 onto the rescue stretcher 100.

With reference to FIGS. 1 and 2, the rescue stretcher 100 further includes a pair of leg straps 345, 350 that encircle the legs of the injured person 50 and help restrain the injured person 50 against the base panel 105. The leg straps 345, 350 each include a buckle 355, 360, respectively, that couples to a corresponding buckle 365, 370 attached to the support mat 225 as further described in detail below. In some embodiments, the buckles 365, 370 may be attached to ends of a continuous webbing strap 395 that is in turn stitched or otherwise fixedly attached to the rear portion 235 of the support mat 225. In some embodiments, the webbing strap 395 extends transversely across the rear portion 235 of the support mat 225, and the webbing straps 385, 390 are arranged to cross over the webbing strap 395 on the rear portion 235 of the support mat 225, as illustrated in FIG. 4. In such embodiments, the webbing straps 385, 390 and the webbing strap 395 may together be stitched or affixed to the support mat 225 at their respective crossover points.

In some embodiments, the shoulder straps 210, 215 and the leg straps 345, 350 may each be formed as part of a single continuous elongate strip of fabric, such as woven nylon webbing, although other materials may also be suitable. For example, with reference to FIG. 4, the webbing may include the shoulder straps 210, 215 on an upper portion of the webbing, and the leg straps 345, 350 on the lower portion of the webbing, such that a single strip of webbing is used to form both strap components. Preferably, the single, elongate strap is stitched or otherwise coupled to the support mat 225 at two or more attachment points to firmly secure the webbing to the support mat 225. In other embodiments, the shoulder straps 210, 215 and the leg straps 345, 350 may instead be standalone straps.

With general reference to FIGS. 1-4, the following description relates to an example operation of the rescue stretcher 100. In one operation, the rescue stretcher 100 is carried to a position where injured person 50 is located and laid flat on the ground with the rear of the base panel 105 contacting the ground. With the base panel 105 flat on the ground and the variety of straps 190, 210, 215, 345, 350 in an unbuckled position, the person 50 is carried onto the base panel 105 and laid on the support mat 225. Depending on the size of the person 50, the support mat 225 may be underneath a portion of the person's torso, with the head of the person 50 resting against the base panel 105 and the legs of the person 50 extending beyond the footer end 115 of the base panel 105.

Once the person 50 is properly positioned on the base panel 105 and support mat 225, person 50 is restrained on rescue stretcher 100 using securement straps 190, 210, 215, 345, 350. In some embodiments, the shoulder straps 210, 215 are first secured and cinched as needed. With particular reference to FIGS. 2 and 4, the shoulder strap 210 is stretched over the shoulder of the injured person 50 and underneath the support mat 225 to couple with buckle 375. Similarly, the shoulder strap 215 is stretched over the shoulder of the injured person 50 and underneath the support mat 225 to couple with buckle 380. In other embodiments, the shoulder straps 210, 215 may instead cross over the chest of the injured person 50 and couple to the opposite buckles on opposite sides of the support mat 225. For example, the shoulder strap 210 may cross over the chest of the person 50 and couple to buckle 380, and the shoulder strap 215 may cross over the chest of the person 50 and couple to buckle 375.

Once the shoulder straps 210, 215 are coupled, the leg straps 345, 350 may then be coupled to secure the person 50. The leg strap 345 is stretched over the upper leg or thigh of the person 50 and the buckles 355, 365 are coupled to each other, and the leg strap 350 is stretched over the other upper leg or thigh of the person 50 and the buckles 360, 370 are coupled to each other. The straps 345, 350 may then be cinched as needed to ensure the person 50 is tightly secured.

With the shoulder straps 210, 215 and the leg straps 345, 350 tightened and secured, the securement straps 190 are stretched transversely across person 50, secured with the buckles 195, 200, and cinched as necessary. When straps 190 are cinched, left and right edges 130, 135 of base panel 105 roll inwardly toward one another so that base panel 105 cradles and better supports person 50.

In the described configuration, transverse straps 190 support person 50 and hold the rescue stretcher 100 in a rolled configuration to help resist movement of the person 50 toward the left and right edges 130, 135 of base panel 105.

In addition, shoulder straps 210, 215 arrest the shoulder and resist sliding movement of the person 50 toward header end 110, while leg straps 345, 350 support the legs and resist movement toward the footer end 115. Once the person 50 is secured on rescue stretcher 100, rescue personnel can carry person 50 using the plurality of loop handles 160, 165 or pull person 50 using drag strap 170 as necessary.

In some operations, person 50 may be extracted using a combination of dragging and/or carrying techniques. For example, person 50 may be carried over some obstacles that are harder to maneuver around and dragged through narrow areas or in situations where only one rescuer is available. In other operations, the lift buckles 305, 310 coupled to the shoulder straps 210, 215 may provide vertical lift attachment points to airlift the rescue stretcher 100 as needed. In yet other operations, the drag strap 170 and/or the plurality of loop handles 160 may be attached to a winch or other similar device to drag or hoist the person 50 to safety, such as by helicopter. In still other operations, a harness or other restraint (not shown) may be threaded through some or all of the apertures on the rescue stretcher to support air-lifting rescues. Other operations not specifically mentioned herein may also be possible.

It will be obvious to those having skill in the art that many changes may be made to the details of the above-described embodiments without departing from the underlying principles of the invention. The scope of the present invention should, therefore, be determined only by the following claims.

The invention claimed is:

1. A stretcher comprising:

an elongate, flexible panel sized to underlay a person laying thereon, the panel including a header end and an opposite footer end, a first side and an opposite second side, the panel further including a first opening formed proximal the header end of the panel and a second opening formed proximal the footer end of the panel, wherein the first and second openings are aligned relative to each other along a longitudinal axis of the panel;

a support mat resting against the flexible panel, the mat including a top surface and an opposite rear surface; and a stability strap fixedly coupled to the rear surface of the support mat, the stability strap including a first segment coupled to the first opening of the flexible panel and a second segment coupled to the second opening of the flexible panel, the stability strap operable to retain the support mat in position against the flexible panel.

2. The stretcher of claim 1, further comprising:

a first buckle and a second buckle, the first and second buckles coupled to the support mat; and a first shoulder strap and a second shoulder strap, each of the first and second shoulder straps fixedly coupled to the support mat, wherein the first shoulder strap includes a shoulder buckle operable to releasably couple with the first buckle, and wherein the second shoulder strap includes a second shoulder buckle operable to releasably couple with the second buckle.

3. The stretcher of claim 2, wherein the first and second buckles are coupled to the rear surface of the support mat, and wherein the first and second shoulder straps each being configured to extend over a corresponding shoulder of the person laying on the flexible panel and couple to the first and second buckles, respectively, on the rear surface of the support mat.

4. The stretcher of claim 2, further comprising a connector strap attached to the first shoulder strap and the second shoulder strap, the connector strap linking the first and second shoulder straps to one another.

5. The stretcher of claim 2, each of the first and second shoulder straps further including a lift buckle coupled thereto, the lift buckles providing an attachment point for airlifting the stretcher.

6. The stretcher of claim 1, further comprising a first buckle and a second buckle, the first and second buckles coupled to the support mat; and a first leg strap and a second leg strap, each of the first and second leg straps fixedly coupled to the support mat, wherein the first leg strap includes a leg buckle operable to releasably couple with the first buckle, and wherein the second leg strap includes a second leg buckle operable to releasably couple with the second buckle.

7. The stretcher of claim 6, wherein the first and second buckles are coupled to the rear surface of the support mat, and wherein the first and second leg straps each being configured to extend over a corresponding leg of the person laying on the flexible panel and couple to the first and second buckles, respectively, on the rear surface of the support mat.

8. The stretcher of claim 1, further comprising a securement strap fixedly coupled to the flexible panel, the securement strap including a first segment with a first buckle and a second segment with a second buckle, wherein the securement strap extends transversely across the flexible panel from the first side to the second side thereof when the first and second buckles mate with one another.

9. The stretcher of claim 1, further comprising a pair of loop handles coupled to the flexible panel, a first one of the loop handles disposed adjacent the first side of the flexible panel and a second one of the loop handles disposed adjacent the second side of the flexible panel.

10. The stretcher of claim 1, further comprising a drag strap coupled to the flexible panel along the header end thereof, the drag strap extending beyond the header end of the flexible panel.

11. The stretcher of claim 1, further comprising a first elongate strap fixedly coupled to the support mat, the first elongate strap offset from the stability strap, wherein the first elongate strap includes a first segment forming a first shoulder strap with a first shoulder buckle coupled thereto, and a second segment forming a first leg strap with a first leg buckle coupled thereto.

12. The stretcher of claim 11, wherein the support mat further includes a first buckle and a second buckle, and wherein the first shoulder buckle is operable to releasably couple with the first buckle, and wherein the first leg buckle is operable to releasably couple with the second buckle.

13. The stretcher of claim 11, further comprising a second elongate strap fixedly coupled to the support mat, the second elongate strap offset from the stability strap and from the first elongate strap, wherein the second elongate strap includes a first segment forming a second shoulder strap with a second shoulder buckle coupled thereto, and a second segment forming a second leg strap with a second leg buckle coupled thereto.

14. The stretcher of claim 13, wherein the support mat further includes a first buckle, a second buckle, a third buckle, and a fourth buckle, and wherein the first shoulder buckle is operable to releasably couple with the first buckle, the second shoulder buckle is operable to releasably couple with the second buckle, the first leg buckle is operable to releasably couple with the third buckle, and the second leg buckle is operable to releasably couple with the fourth buckle.

15. The stretcher of claim 14, further comprising a securement strap fixedly coupled to the flexible panel, the securement strap including a first segment with a first strap buckle and a second segment with a second strap buckle, wherein the securement strap extends transversely across the flexible panel from the first side to the second side thereof when the first and second strap buckles mate with one another.

16. The stretcher of claim 15, wherein the securement strap is fixedly coupled to the rear surface of the support mat, the securement strap traversing the first and second elongate straps and the stability strap.

* * * * *